United States Patent [19]

Derouin

[11] Patent Number: 4,880,238

[45] Date of Patent: Nov. 14, 1989

[54] LOCKING PUZZLE

[76] Inventor: Louis G. Derouin, P.O. Box 545, Gibbons, Alberta, Canada, T0A 1N0

[21] Appl. No.: 206,717

[22] Filed: Jun. 15, 1988

[51] Int. Cl.[4] ..... A63F 9/12

[52] U.S. Cl. ..... 273/160

[58] Field of Search ..... 273/156, 160

[56] References Cited

U.S. PATENT DOCUMENTS

| | | | |
|---|---|---|---|
| 430,502 | 6/1890 | Altekruse | 273/160 |
| 943,496 | 12/1909 | Weigt | 273/160 |
| 1,221,149 | 4/1917 | D'Autremont | 273/160 |
| 1,225,760 | 5/1917 | Brown | 273/160 |
| 1,350,039 | 8/1920 | Senyk | 273/160 |
| 1,455,009 | 5/1923 | Schenk | 273/160 |
| 2,181,116 | 11/1939 | Boyle | 273/156 |
| 3,684,292 | 8/1972 | Penrod et al. | 273/156 |

FOREIGN PATENT DOCUMENTS

| | | | |
|---|---|---|---|
| 94613 | 8/1905 | Canada . | |
| 576398 | 5/1959 | Canada | 273/156 |

*Primary Examiner*—Anton O. Oechsle

[57] ABSTRACT

The disclosure describes a puzzle of the type having a plurality of elongate blocks which may be assembled in an interlocking arrangement. Two of the blocks include a locking mechanism whereby in a first orientation of the assembled puzzle disassembly thereof is prevented while in a second rotated orientation the locking mechanism may be deactivated to permit disassembly.

5 Claims, 5 Drawing Sheets

STEP 1

STEP 2

STEP 3

STEP 4

STEP 5

LOCKING PUZZLE

This invention relates to puzzles of the type wherein a plurality of blocks may be assembled to form a specific shape and more particularly to a puzzle having a locking mechanism which prevents disassembly of the puzzle until the operation of the locking mechanism is understood.

Puzzles of various types have been in existence for many years. Some of these puzzles are simply to amuse while others are designed to provide a test of the operator's skill and patience. Many of the known puzzles include a plurality of individual pieces which can only be assembled in one particular manner in order for the puzzle to be complete.

The puzzle of the present invention provides an additional test in as much as it includes a locking element which retains the puzzle in an assembled mode until the operator is able to solve the locking mechanism. Thus, the puzzle includes a plurality of blocks which can be assembled in a particular manner whereby a pair of locking blocks keeps the puzzle together until the locking blocks are removed.

Therefore in accordance with the present invention there is provided a puzzle comprising an arrangement of elongate, blocks each being square and equal in cross section and having the same length, said blocks being provided with suitably located rabbets so as to permit interlocking thereof into an assembled puzzle, two of said blocks being adapted to receive a pair of locking members such that in a first orientation of said assembled puzzle said two blocks and said locking members retain said puzzle in an assembled, locked position and in a second rotated orientation said locking members allow said two blocks to unlock thereby permitting disassembly of said puzzle.

The invention will now be described in greater detail with reference to the appended drawings wherein.

Figure 1:
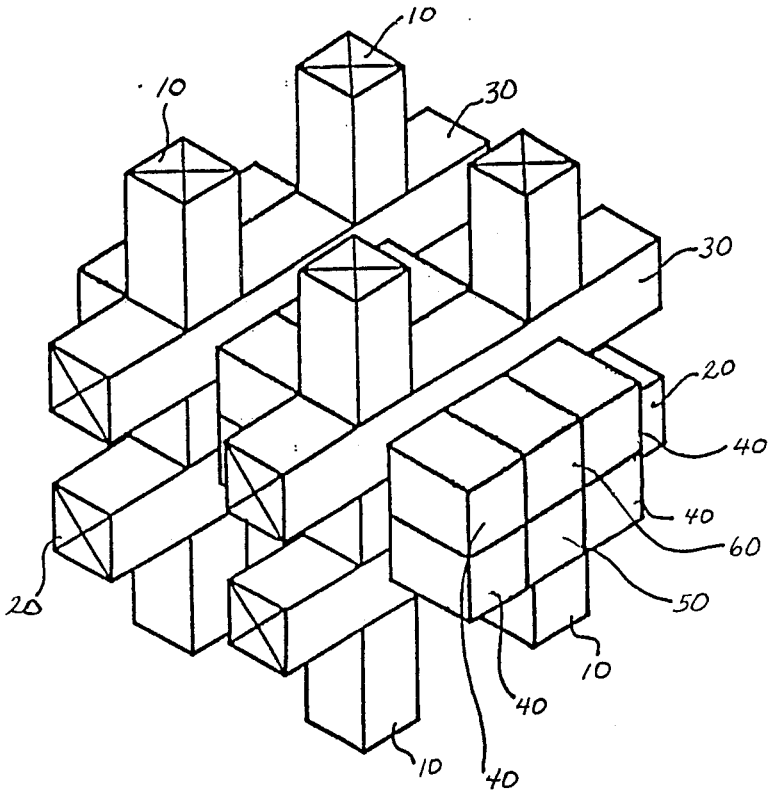
FIG. 1 is a perspective view of the puzzle completely assembled.

As shown in FIG. 1 the puzzle in the assembled mode comprises six tightly packed centrally positioned blocks with two frame like members each being made up of four blocks. In the assembled configuration it is not readily apparent which block is to be removed first or, in fact, the manner in which the puzzle may be disassembled.

The individual pieces of the puzzle are shown in detail in FIGS. 2A to 2G. Starting first with FIG. 2A there is illustrated block 10, the main component of the frame referred to on connection with FIG. 1. There are four blocks identical to block 10 as they appear as the four vertical components of the frame. Two rabbets 11, 12 of equal size are formed in one longitudinal face 13, the depth of each rabbet being equal to one half the thickness of the block and the length of the rabbets is equal to the width of the block. The spacing between each rabbet is equal to the thickness of each block.

Figure 2A:
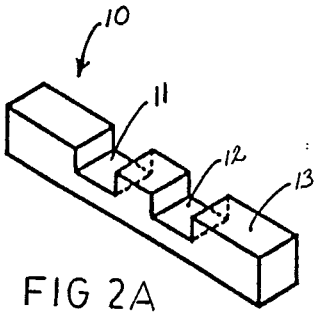
FIGS. 2A to 2G are perspective views of individual pieces of the puzzle.
Figure 2E:
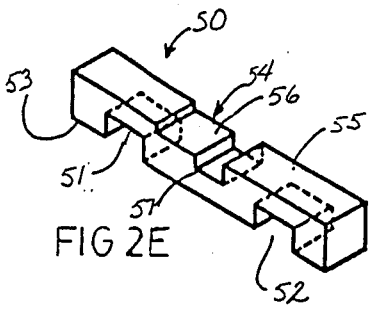
Figure 2B:
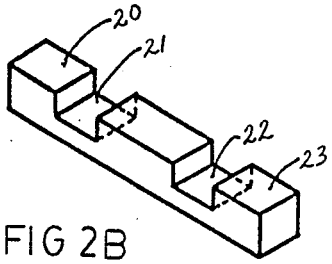

The block 20 shown in FIG. 2B is the same length and width as block 10. In fact all of the blocks with the exception of the two locking blocks to be described hereinafter are of substantially the same length and cross section, the cross section being square. Block 20 has two rabbets 21, 22 on face 23, again these rabbets as well as all of the rabbets on all of the blocks unless otherwise described are of the same dimensions as those described in connection with block 10. Rabbets 21, 22 are spaced apart by a distance equal to twice the width of the blocks. There are two blocks of the type illustrated in FIG. 2B.

Figure 2F:
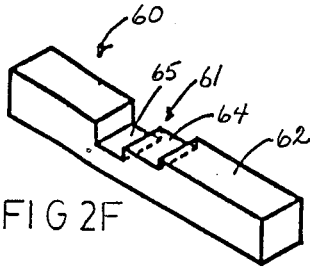
Figure 2C:
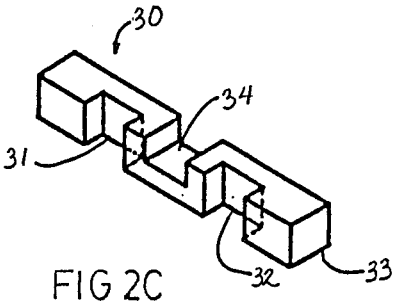

There are also two blocks 30 of the configuration shown in FIG. 2C. These are the same as blocks 20 except that in addition to rabbets 31, 32 on face 33 there is a rabbet 34 centrally located on side 35 which is adjacent side 33.

Figure 2G:
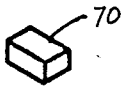
Figure 2D:
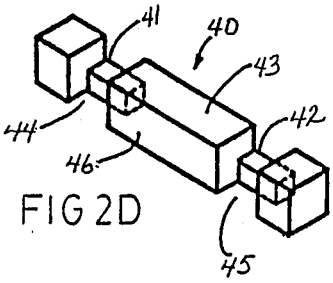

There are four blocks 40 of the type illustrated in FIG. 2D. Blocks 40 each have two rabbets 41, 42 on side 43 and two rabbets 44, 45 on side 46. Rabbet 41 and rabbet 44 are at the same location as are rabbets 42, 45 and the spacing between each rabbet is equal to twice the width of each block. In this way the block in the region of the rabbets is only one half the normal thickness of the block in both directions.

There is one block 50 illustrated in FIG. 2E. Block 50 includes two rabbets 51, 52 on side 53 and a double rabbet 54 on side 55 which is directly opposite side 53. Rabbet 54 has a first shallow section 56 and a second deeper section 57. The length of shallow section 56 is approximately equal to the width of the block while the length of section 57 is approximately one half the width of the block.

There is also one block 60 shown in FIG. 2F. Block 60 has a double rabbet 61 on side 62. Rabbet 61 has a first shallow section 64 and a second deeper section 65. The length of shallow section 64 is less than the width of the block or approximately three-quarters of the width. Deep section 65 is identical to section 57.

Finally there are two locking blocks 70 as shown in FIG. 2G. Blocks 70 are slightly thinner than the depth of rabbet sections 57, 65, the same width as the blocks and approximately the same length as the length of sections 57, 65. Blocks 70 are intended to fit into rabbet sections 57, 65.

The assembly of the puzzle will now be described with reference to steps 1 to 5 illustrated in FIG. 3A to FIG. 3E.

Figure 3A:
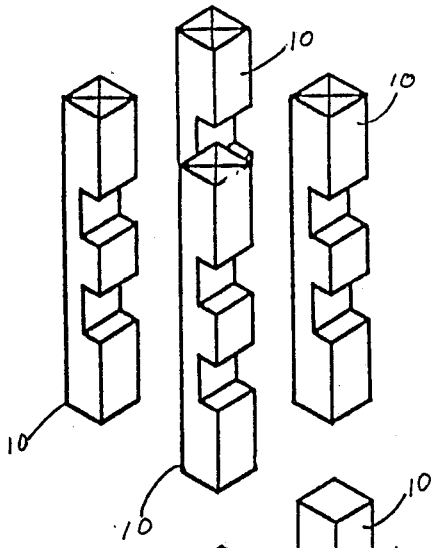
FIGS. 3A to 3E are perspective views of the assembly steps.
Figure 3B:
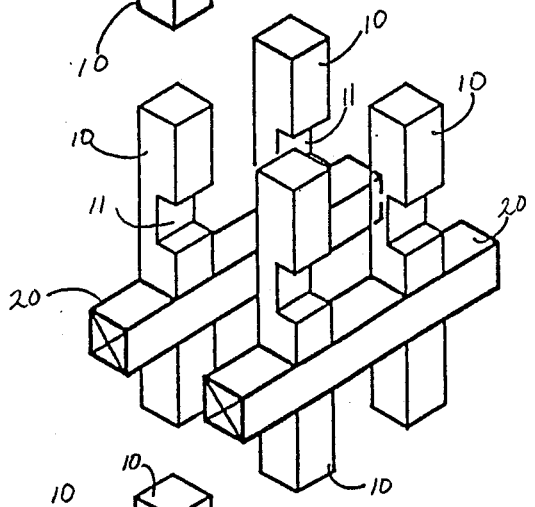
Figure 3C:
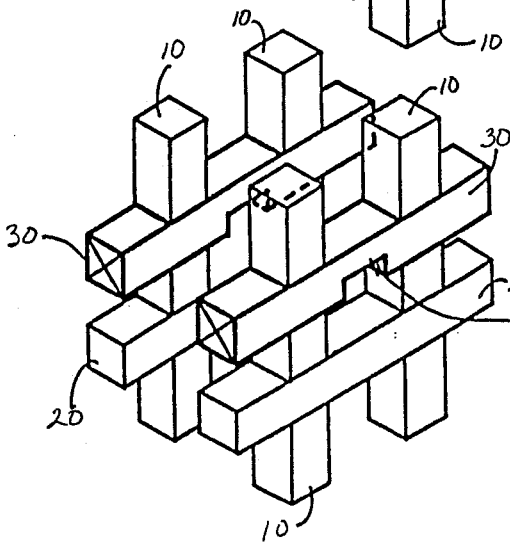

In FIG. 3A the four blocks 10 are assembled in a vertical orientation. Next, as shown in step 2, FIG. 38, the two blocks 20 are positioned horizontally between two pairs of blocks 10 such that rabbets 12 interlock rabbets 21, 22. As shown in FIG. 3C blocks 30 are interlocked with the two pairs of blocks 10 such that rabbets 31, 32 fit into rabbets 11, and rabbet 34 faces downwardly.

Figure 3D:
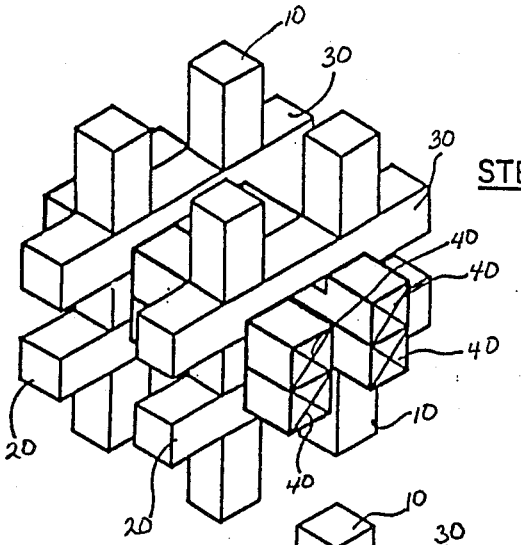
Figure 3E:
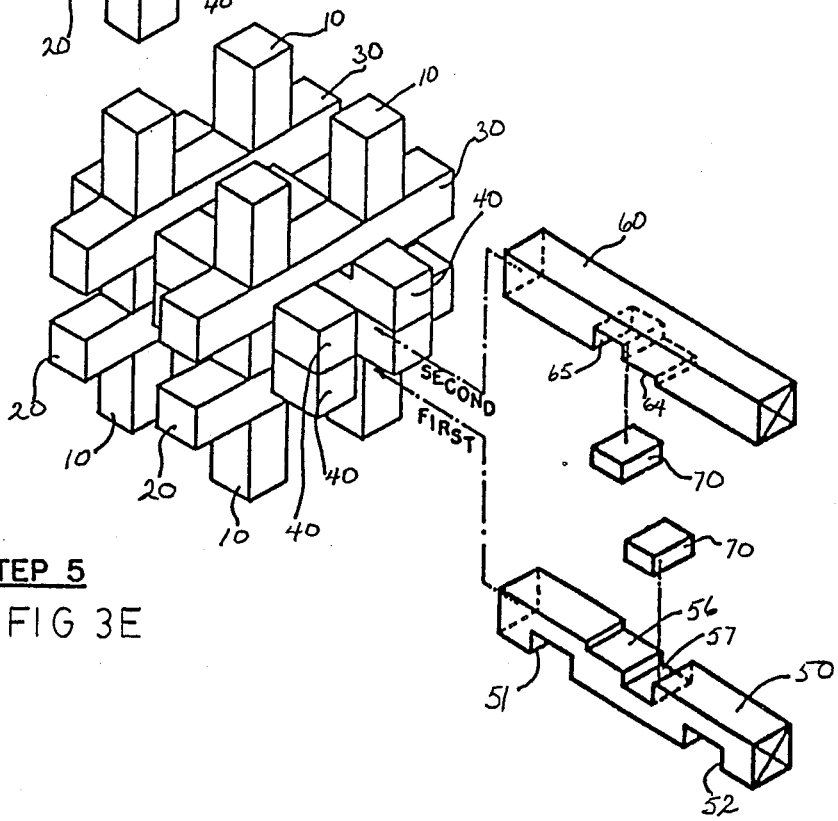

Step 4 illustrated in FIG. 3D involves the assembly of blocks 40 into the two frames produced by blocks 10, 20 and 30. Blocks 40 are assembled one at a time into the frame such that rabbets 41, 44 interlock with the inside corner of one frame and rabbets 42, 45 interlock the inside corner of the other. This leaves a vertical gap between blocks 40 equal to the width of a block. As shown in step 5, FIG. 3E, block 50 is placed into the gap and moved downwardly as far as possible so that rabbets 51, 52 interlock cross members or blocks 20. A first locking block 70 is placed into section 57. Block 60 is held so that rabbet 61 faces upwardly and the second locking block 70 is placed in section 65. Block 60 is then rotated 180 degrees while the block 70 is retained in section 65 by means of the operator's hand. Block 60 is then slid into the existing gap such that the double rabbets 54, 61 are face to face and that the two locking blocks 70 are at opposite ends of the two double rabbets. Once the puzzle is completely assembled in this manner it cannot be disassembled since the locking blocks prevent the blocks 50, 60 from sliding apart again.

The manner in which locking occurs and the steps required to unlock the mechanism will now be described with reference to FIGS. 4A to 4F. Block 50 is prevented from sliding by the interlocking engagement of rabbets 51, 52 in blocks 20. As block 60 slides in over block 50, locking block 70 in section 65 is held in place. Once block 60 is all the way into the gap block 70 is free to fall down to rest on section 56 of block 50. Thus block 70 prevents further sliding or at least sufficient sliding to permit disassembly in as much as in one direction the other block 70 blocks further movement while in the other direction the edge 66, stops the blocks from sliding further.

Figure 4A:
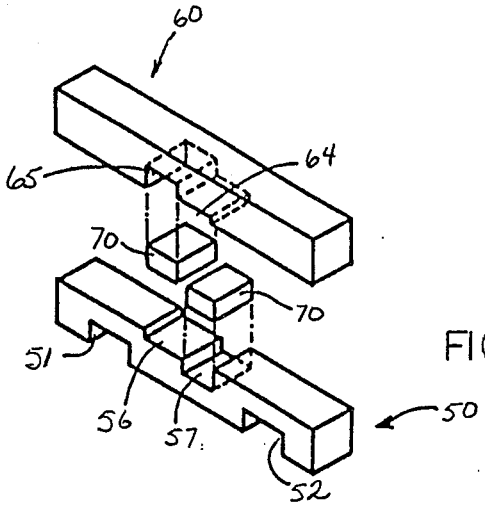
FIGS. 4A to 4E illustrate the locking mechanism.
Figure 4B:
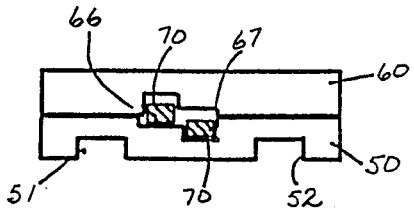
Figure 4C:
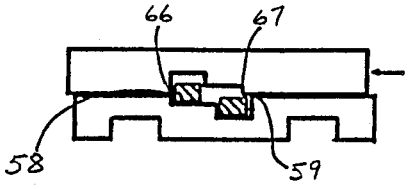
Figure 4D:
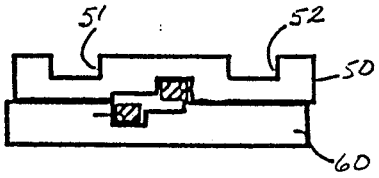
Figure 4E:
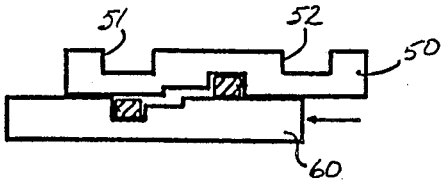

To unlock the locking mechanism the top block, block 60 is moved to the left as far as it will go. This aligns edge 66 of block 60 with edge 58 of block 50. As shown in FIG. 4C this causes a misalignment of edge 67 on block 60 and edge 59 on block 50. While in this position the puzzle is rotated through 180 degrees as illustrated in FIG. 4D. Block 70 in section 57 is held in place by edge 67 of block 60 while block 70 in section 65 is free to fall to the bottom of the deep rabbet. Block 60 can now be pushed out to the left to permit complete disassembly of the puzzle.

In a preferred embodiment of the invention the blocks are made of wood although it is anticipated that other materials such as plastics may be used. The blocks according to a preferred embodiment have the following typical dimensions: length—four and three quarter inches and cross section—three quarters of an inch square. The locking blocks measure three quarters of an inch by one half inch by three eights of an inch. Obviously these dimensions are typical only and variations are contemplated as long as the interlocking relationships are maintained.

While the invention has been described in detail with respect to specific embodiments it will be understood that variations and modifications may be made without departing from the essential features thereof.

The embodiments of the invention which an exclusive property or privilege is claimed are defined as follows:

1. A puzzle comprising an arrangement of elongate blocks each being square and equal in cross section and having the same length, said blocks being provided with suitably located rabbets so as to permit interlocking thereof into an assembled puzzle, two of said blocks being adapted to receive a pair of locking members such that in a first orientation of said assembled puzzle said two blocks and said locking members retain said puzzle in an assembled, locked position and in a second rotated orientation said locking members allows said two blocks to unlock thereby permitting disassembly of said puzzle.

2. A locking puzzle comprising an arrangement of fourteen elongate, parallelepiped blocks, each block being of the same length and having the same square cross section, twelve of said blocks each having at least two parallel sided recesses therein said recesses extending laterally and having a length equal to the width and a depth equal to one half the width, said twelve blocks adapted to be arranged in an interlocking assembled mode, said remaining two blocks having means cooperating with a pair of locking blocks such that in a first orientation of said assembled puzzle said two blocks and said locking blocks maintain said puzzle locked in an assembled mode and in a second rotated orientation said locking blocks allow said two blocks to unlock thereby permitting disassembly of said puzzle.

3. A locking puzzle comprising fourteen elongate, parallelepiped blocks, each block being the same length and having equal square cross section, twelve of said blocks having at least two rabbets on one or more sides, said blocks adapted to be assembled in an interlocking manner, said remaining two blocks being adapted to receive a pair of locking blocks therebetween so that said two blocks complete said puzzle whereby in a first orientation of said puzzle said two blocks and said locking blocks retain said puzzle in a locked assembled mode and in a second rotated orientation said locking blocks unlock said two blocks thereby permitting disassembly of said puzzle.

4. A locking puzzle according to claim 1, wherein a first of said two blocks has a pair of rabbets on one face adapted to interlock in said puzzle and the opposite face having centrally disposed a single rabbet with a first deep section and a second shallow section and the second of said two blocks having a centrally disposed rabbet on one face with a first deep section and a second shallow section, said shallow section in said first block being longer than said shallow section in said second block, said locking blocks being configured to fit into each of said first deep sections so that when said two blocks are assembled with said rabbets facing each other in one orientation said two blocks are prevented from sliding longitudinally while in a rotated orientation said two blocks are free to slide longitudinally.

5. A locking puzzle according to claim 4 wherein the thickness of said locking block is substantially equal to the depth of said deep sections in said first and second blocks.

* * * * *